US009915460B2

(12) United States Patent
Yang

(10) Patent No.: US 9,915,460 B2
(45) Date of Patent: Mar. 13, 2018

(54) ICE TRAY FOR ICE-MAKING DEVICE AND METHOD OF MAKING ICE

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 114 days.

(21) Appl. No.: 14/840,047

(22) Filed: Aug. 31, 2015

(65) Prior Publication Data

US 2016/0370066 A1 Dec. 22, 2016

(30) Foreign Application Priority Data

Jun. 17, 2015 (KR) ..... 10-2015-0085884

(51) Int. Cl.

| | |
|---|---|
| ***F25C 1/18*** | (2006.01) |
| ***F25C 1/20*** | (2006.01) |
| *F25C 1/24* | (2018.01) |
| *F25C 1/10* | (2006.01) |

(52) U.S. Cl.

CPC ..... *F25C 1/20* (2013.01); *F25C 1/10* (2013.01); *F25C 1/24* (2013.01)

(58) Field of Classification Search

CPC ..... F25C 1/24; F25C 1/10; F25C 1/20

USPC ..... 62/68

See application file for complete search history.

(56) References Cited

U.S. PATENT DOCUMENTS 6,742,351 B2 * 6/2004 Kim ..... F25C 1/08 62/352

FOREIGN PATENT DOCUMENTS

| | | |
|---|---|---|
| JP | 5-332650 | 12/1993 |
| JP | 2001-41620 | 2/2001 |
| JP | 2001-41622 | 2/2001 |
| KR | 10-2012-0026342 | 3/2012 |
| KR | 10-2012-0033742 | 4/2012 |
| KR | 10-2012-0064026 | 6/2012 |
| WO | 2012/077972 | 6/2012 |

* cited by examiner

*Primary Examiner* — Frantz Jules
*Assistant Examiner* — Steve Tanenbaum

(57) ABSTRACT

According to an embodiment, an ice tray comprising: a tray body configured to provide ice-making spaces configured to retain water; a plurality of partition walls extending upward from a bottom surface of the tray body to define the ice-making spaces; and a vibration-generating unit configured to vibrate the tray body. The vibration-generating unit can include a vibration-generating member configured to generate vibration and a mounting member configured to mount the vibration-generating member to a lower surface of the tray body.

5 Claims, 7 Drawing Sheets

ICE TRAY FOR ICE-MAKING DEVICE AND METHOD OF MAKING ICE

RELATED APPLICATION

This application is based on and claims priority to Korean Patent Application No. 10-2015-0085884, filed on Jun. 17, 2015, the disclosure of which is incorporated herein in its entirety by reference.

FIELD

The present disclosure relates to ice trays for ice-making devices and methods of making ice.

BACKGROUND

A refrigerator is an apparatus for storing food at a relatively low temperature and may be configured to store food in a frozen state or a refrigerated state. A decision to store food in a frozen state or refrigerated state may depend on the kind of food to be stored.

The interior of the refrigerator is cooled by supplied cold air, in which the cold air is typically generated by a temperature exchange action of a refrigerant according to a cooling cycle including compression, condensation, expansion and evaporation. The cold air supplied to the inside of the refrigerator can be distributed in the refrigerator by convection. Thus, items within the refrigerator can be stored at a desired temperature.

A refrigerator typically includes a main body having a rectangular parallelepiped shape with an open front side. A refrigerating compartment (e.g.; refrigerating space, portion, room, etc.) and a freezing compartment (e.g.: freezing space, portion, room, etc.) may be provided within the main body. A refrigerating compartment door and a freezing compartment door for selectively closing and opening the refrigerator compartment and the freezing compartment may be provided on the front side or surface of the main body. A plurality of drawers, shelves and container boxes for storing different kinds of food in a desired state may be provided in the internal storage spaces of the refrigerating compartment and freezing compartment.

Conventionally, mainstream refrigerators are top-mount-type refrigerators having a freezing compartment positioned at an upper side or portion of the refrigerator and a refrigerating compartment positioned at the lower side or portion of the refrigerator. There are also commercially available bottom-freeze-type refrigerators. Bottom-freeze-type refrigerators can enhance user convenience in which a more frequently-used refrigerating compartment is positioned at an upper portion of the refrigerator and a less frequently used freezing compartment is positioned at a lower portion of the refrigerator. This provides an advantage in that a user can conveniently use the refrigerating compartment. However, the bottom-freeze-type refrigerators (in which the freezing compartment is positioned at the lower portion or side) can pose an inconvenience when a user does access the freezing compartment, in that a user typically has to bend at the waist to open the freezing compartment door (e.g., to take out pieces of ice, food, etc.).

Traditional attempts at solving the above problem in the bottom freeze type refrigerators have included an ice dispenser installed in the refrigerating compartment or refrigerating compartment door in some implementations. In this approach, the refrigerating compartment door or the inside of the refrigerating compartment may be provided with an ice maker which generates ice.

The ice-making device may include an ice-making assembly provided with an ice tray for producing pieces of ice (e.g., in various shapes including cubes, cylindrical, semi-spherical, etc.), an ice bucket which stores the pieces of ice, and a feeder assembly which feeds the pieces of ice stored in the ice bucket to the dispenser.

In a conventional ice tray, a plurality of ice-making spaces capable of retaining water are formed on the upper surface of a tray body. A water supply port capable of supplying water to the ice-making spaces is formed on one surface of the tray body. Water supplied through the water supply port may be cooled in a cooling space of the ice-making device. As a result, water may be phase-transformed into pieces of ice.

A relatively large amount of gas is typically dissolved in water and may be continuously evaporated, thereby causing bubbles to form on the surface of water. However, pieces of ice produced using bubble-containing water may have an undesirable opaque outward appearance.

SUMMARY

The present disclosure includes descriptions of ice trays which are capable of removing bubbles from water in the ice tray by vibrating the body of the ice tray. Furthermore, the present disclosure includes a method of making ice, which is capable of removing bubbles from water in an ice tray.

In one embodiment, and ice tray includes: a tray body including ice-making spaces configured to retain water; a plurality of partition walls extending upward from a bottom surface of the tray body to define the ice-making spaces; and a vibration-generating unit configured to vibrate the tray body. The vibration-generating unit includes: a vibration-generating member configured to generate vibration; and a mounting member configured to couple the vibration-generating member to the tray body.

In one embodiment, the vibration-generating unit comprises: a shaft member provided on a surface of the mounting member and a swing bar extending in the longitudinal direction of the tray body and inserted into the mounting hole of the shaft member. The shaft member includes a mounting hole extending in a longitudinal direction of the tray body. The swing bar is configured to swing up and down about the shaft member when vibration is generated in the vibration-generating member. In one exemplary implementation, one or more striking pieces extending upward are formed on an upper surface of the swing bar and are configured to repeatedly strike a lower surface of the tray body when the swing bar is swung. The striking pieces can be disposed at a predetermined interval along a longitudinal direction of the swing bar, and the length of the striking pieces becomes larger from a free end of the swing bar toward the shaft member. The tray body and the partition walls may be made of a metallic material and may be manufactured at one time by a press work method. The material can be selected from the group consisting of stainless steel, copper and copper alloy.

In one embodiment a method of making ice comprises: supplying water to an ice tray having a tray body; cooling the water; and driving a vibration-generating unit installed in the ice tray, wherein the vibration-generating unit is coupled to a surface of the ice tray and is configured to vibrate the ice tray to remove bubbles contained in the water before the water is completely phase-transformed into ice. A swing bar coupled to the vibration-generating unit through a mounting member and is configured to strike a surface of the ice tray to remove the bubbles when the vibration-generating unit is driven. One or more striking pieces extending upward may be formed on an upper surface of the swing bar and are configured to repeatedly strike a lower surface of the ice tray when the swing bar is swung. The striking pieces can be disposed at a predetermined interval along a longitudinal direction of the swing bar, and the length of the striking pieces become larger from a free end of the swing bar toward the shaft member. In addition, the method can include determining whether an ice-making process is completed in the ice tray, while driving the vibration-generating unit; and if it is determined that the ice-making process is completed, stopping the driving of the vibration-generating unit.

In one embodiment, a method of making an ice tray comprises: forming a tray body including ice-making spaces configured to retain water; creating a plurality of partition walls extending upward from a bottom surface of the tray body to define the ice-making spaces; and providing a vibration-generating unit configured to vibrate the tray body. The vibration-generating unit can include: a vibration-generating member configured to generate vibration; and a mounting member configured to couple the vibration-generating member to the tray body. Forming the tray body and creating the partition walls 12 can include a press work method. The press work method includes pressing a metallic material (e.g., stainless steel, brass, copper, a copper alloy, etc.).

DETAILED DESCRIPTION

Figure 1:
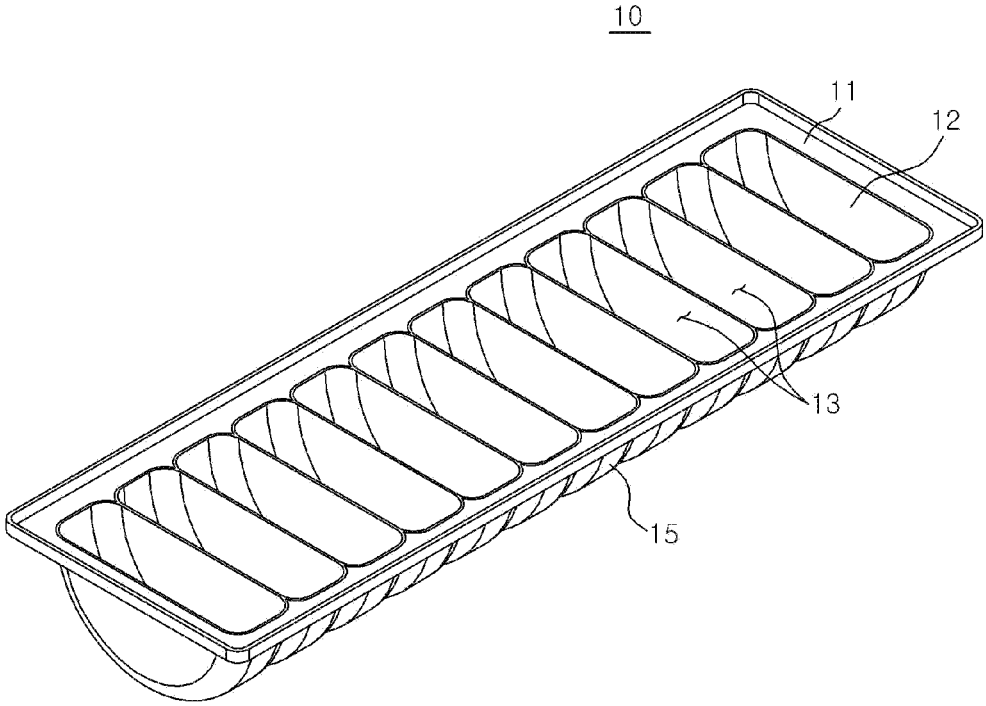
FIG. 1 is a perspective view of an ice tray for an ice-making device according to one embodiment of the present disclosure.

Reference will now be made in detail to the preferred embodiments, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one ordinarily skilled in the art that the present invention may be practiced without these specific details. In other instances, well known methods, procedures, components, and circuits have not been described in detail as not to unnecessarily obscure aspects of the current invention.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure may illustrate example implementations of the present disclosure in more detail. As a result, other implementations with various modifications of the drawings are expected. Accordingly, the exemplary embodiments are not limited to a specific form of the illustrated region, and for example, include a modification of a form by manufacturing.

Figure 2:
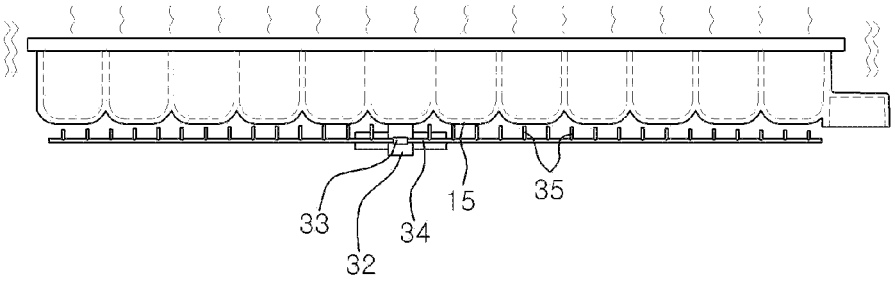
FIG. 2 is a side view of the ice tray illustrated in FIG. 1.

FIG. 1 is a perspective view of an ice tray for an ice-making device according to one embodiment of the present disclosure. FIG. 2 is a side view of the ice tray illustrated in FIG. 1, and FIG. 3 is a perspective view of a vibration-generating unit provided in the ice tray illustrated in FIG. 1.

Figure 3:
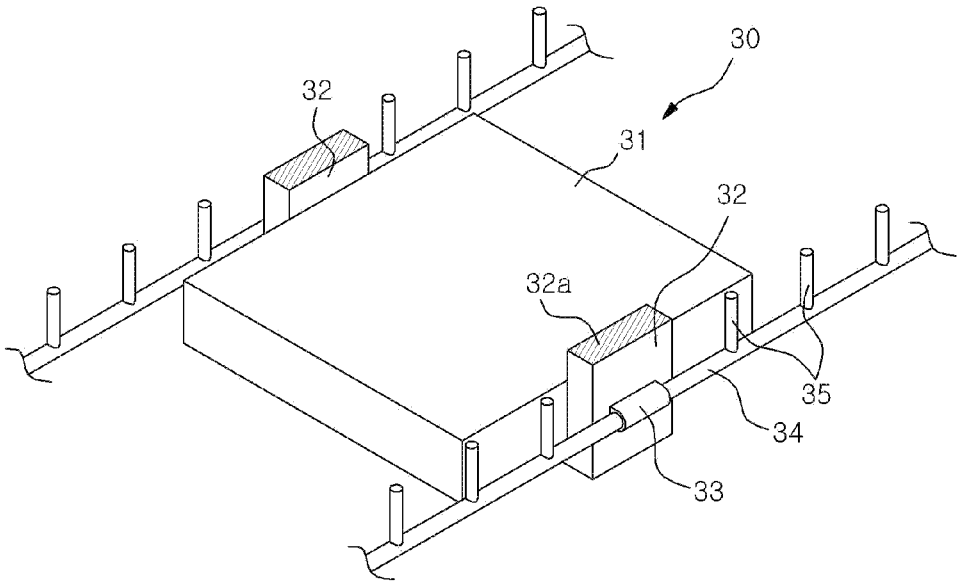
FIG. 3 is a perspective view of a vibration-generating unit coupled to the ice tray illustrated in FIG. 1.

With reference to FIGS. 1 through 3, the ice tray 10 provides ice-making spaces 13 in which water is phase-transformed into pieces of ice. The shape of the pieces of ice produced in the ice-making spaces 13 may correspond to the shape of the ice-making spaces 13. Specifically, the ice tray 10 includes a tray body 11 configured to provide ice-making spaces 13 in which water is retained. Ice tray 10 includes a plurality of partition walls 12 extending upward from a bottom surface of the tray body 11, the partition walls 12 disposed between the ice-making spaces 13 to define the ice-making spaces 13 as separate independent spaces.

The ice-making spaces 13 may have different shapes, such as a star shape, a heart shape and the like, other than the illustrated shape.

As the heat conductivity of the ice tray 10 grows higher, it becomes possible for the ice tray 10 to improve the heat exchange rate between water and a cold air, whereby the ice tray 10 can serve as one kind of heat exchanger. While not illustrated in the drawings, the ice tray 10 may include cooling ribs for increasing the contact area of the ice tray 10 with the cold air.

A vibration-generating unit 30 configured to vibrate the tray body 11 may be coupled to a surface 15 of the tray body 11.

The vibration-generating unit 30 may include a vibration-generating member 31 configured to generate vibration and a pair of mounting members 32 configured to mount the vibration-generating member 31 to the tray body 11. The mounting members 32 may be coupled to one surface of the tray body 11. As illustrated in the drawings, the mounting members 32 may be coupled to the lower surface 15 of the tray body 11. Each of the mounting members 32 may have a bent lower portion. The vibration-generating member 31 may be inserted between the mounting members 32. Alternatively, the mounting members 32 may be formed into a single mounting member having a space into which the vibration-generating member 31 can be inserted. Furthermore, the mounting members 32 may have different shapes other than the illustrated shape as long as the mounting members 32 can couple the vibration-generating member 31 to the tray body 11.

A shaft member 33 having a mounting hole extending in the longitudinal direction of the tray body 11 may be coupled to one surface of each of the mounting members 32. A swing bar 34 extending in the longitudinal direction of the tray body 11 may be inserted into the mounting hole of the shaft member 33. When vibration is generated in the vibration-generating member 31, the swing bar 34 may swing up and down about the shaft member 33. One or more striking pieces 35 extending upward from the upper surface of the swing bar 34 may be formed in the swing bar 34. The striking pieces 35 may be disposed at a predetermined interval along the longitudinal direction of the swing bar 34. The striking pieces 35 may be equal in length to one another. Alternatively, the length of the striking pieces 35 may become larger from the free end of the swing bar 34 toward the shaft member 33.

The ice tray 10, namely the tray body 11 and the partition walls 12 may be manufactured by pressing a metal. The metal may be stainless steel, copper, or copper alloy such as brass or the like. Since the ice tray 10 has a simple structure in which the ice-making spaces 13 are formed on the upper surface of the tray body 11, it is possible to manufacture the ice tray 10 by a press work method.

Unlike an injection molding method in which a product needs to be relatively thick in order to provide durability, the press work method is capable of pressing a metal into a relatively thin product. Accordingly, the ice tray 10 having a relatively-small thickness is capable of rapidly transferring the cold energy of a cold air to the water retained in the ice-making spaces 13. Furthermore, the vibration energy generated in the vibration-generating member 31 may be efficiently transferred to the water.

Since the ice tray 10 has a simple structure, it is easy to clean the ice tray 10. If the ice tray 10 is made of stainless steel having a relatively high corrosion resistance or brass having an anti-bacterial effect, the pieces of ice produced by the ice tray 10 may be less harmful to a human body than the pieces of ice produced by an ice tray made of aluminum containing a substance which may be harmful to a human body.

Next, descriptions will be made on the actions and effects of the ice tray of an ice-making device according to one aspect of the present disclosure and a method of making ice.

The ice tray 10 according to one embodiment is provided in an ice-making device for producing pieces of ice. The ice-making device may include a case having a cooling space, a cooling unit configured to cool the cooling space (and a water supply unit configured to supply water to the ice tray 10. In one example implementation the cooling unit includes a compressor, a condenser, an expansion valve and an evaporator. The ice tray 10 may be disposed within the cooling space of the case.

Figure 4:
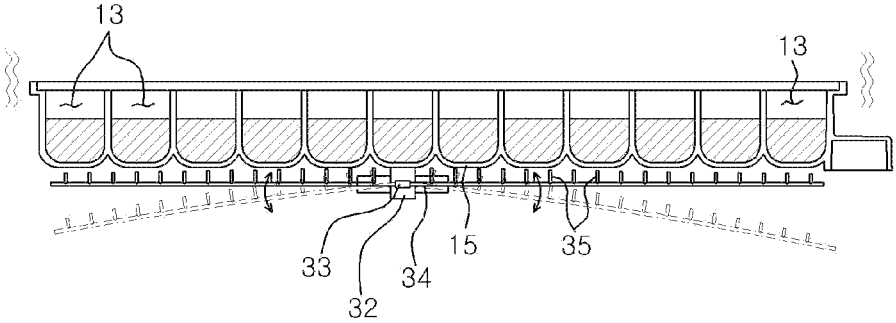
FIG. 4 is a view for explaining an example operation of the vibration-generating unit in the ice tray illustrated in FIG. 2.
Figure 5:
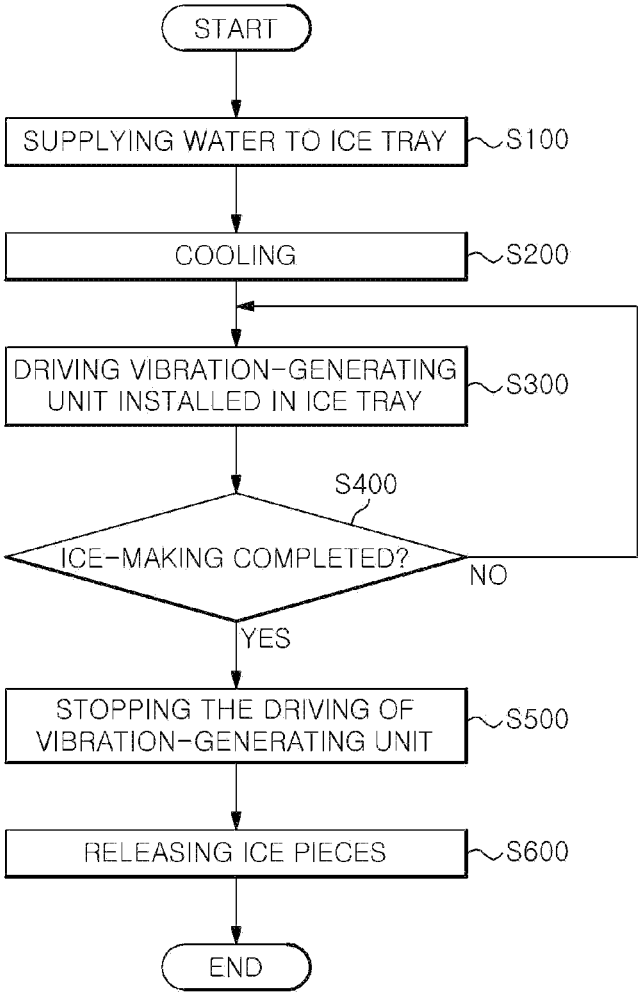
FIG. 5 is a flowchart illustrating a method of making ice using the ice tray illustrated in FIG. 2.

FIG. 4 is a view for explaining an operation of the vibration-generating unit in the ice tray illustrated in FIG. 2, and FIG. 5 is a flowchart illustrating a method of making ice using the ice tray illustrated in FIG. 2.

Referring to FIGS. 4 and 5 and a method of making ice according to one embodiment, if a control unit (not shown) receives an ice-making command from a user or if an amount of pieces of ice stacked in an ice bucket of the ice-making device is low, water may be supplied to the ice-making spaces 13 of the ice tray 10 by the water supply unit (e.g., in step S100). The supplied water may be cooled by the cold energy transferred from the ice tray 1D (e.g., in step S200). Before the water retained in the ice-making spaces 13 is completely phase-transformed into pieces of ice, the control unit may drive the vibration-generating unit 30 installed on the lower surface 15 of the tray body 11, thereby vibrating the tray body 11.

Specifically, the vibration-generating member 31 of the vibration-generating unit 30 may generate vibration under the control of the control unit. The generated vibration may be transferred to the lower surface 15 of the tray body 11 through the mounting members 32. As the vibration is transferred to the lower surface 15 of, the tray body 11, the vibration energy may be transferred from the lower side of the tray body 11 to the upper side thereof. Since the transfer direction of the vibration energy is the same as the direction in which bubbles are separated from the surface of water, it is possible to effectively transfer the vibration energy to the bubbles.

Since the swing bar 34 is coupled to each of the mounting members 32 so as to swing about the shaft member 33, the vibration energy generated by the vibration-generating member 31 may be transferred to the swing bar 34. The swing bar 34 may be swung up and down by the vibration energy. During the swing movement of the swing bar 34, the striking pieces 35 extending upward from the swing bar 34 may repeatedly strike the lower surface 15 of the tray body 11.

Since the length of the striking pieces 35 may become larger from the free end of the swing bar 34 toward the shaft member 33, the striking pieces 35 disposed in the portion of the swing bar 34 existing close to the shaft member 33 and having a small rotation radius may strike the lower surface 15 of the tray body 11.

The control unit may drive the vibration-generating unit 30 for a predetermined time period. Alternatively, the control unit may drive the vibration-generating unit 30 until the water is phase-transformed into pieces of ice, namely until the ice-making process is completed.

In other words, the control unit may determine whether the ice-making process is completed (e.g., in step S400). If it is determined that the ice-making process is not completed, the control unit allows the cooling step to continue. If it is determined that the ice-making process is completed, the control unit may stop the drive of the vibration-generating unit 30 (e.g., in step S500). Then, the pieces of ice thus produced may be separated or released from the ice tray 10 using ejectors or the like (e.g., in step S600).

Accordingly, in one embodiment, the ice tray 10 may be vibrated by the vibration energy generated in the vibration-generating member 31. As a result, bubbles may be removed from the water. In addition, the tray body 11 may be repeatedly struck by the swing bar 34 and the striking pieces 35. Thus, bubbles may be effectively removed from the water.

Since the striking pieces 35 may be provided in a plural number in the swing bar 34 extending along the longitudinal direction of the tray body 11, it is possible for the striking pieces 35 to strike different points of the tray body 11.

Figure 6:
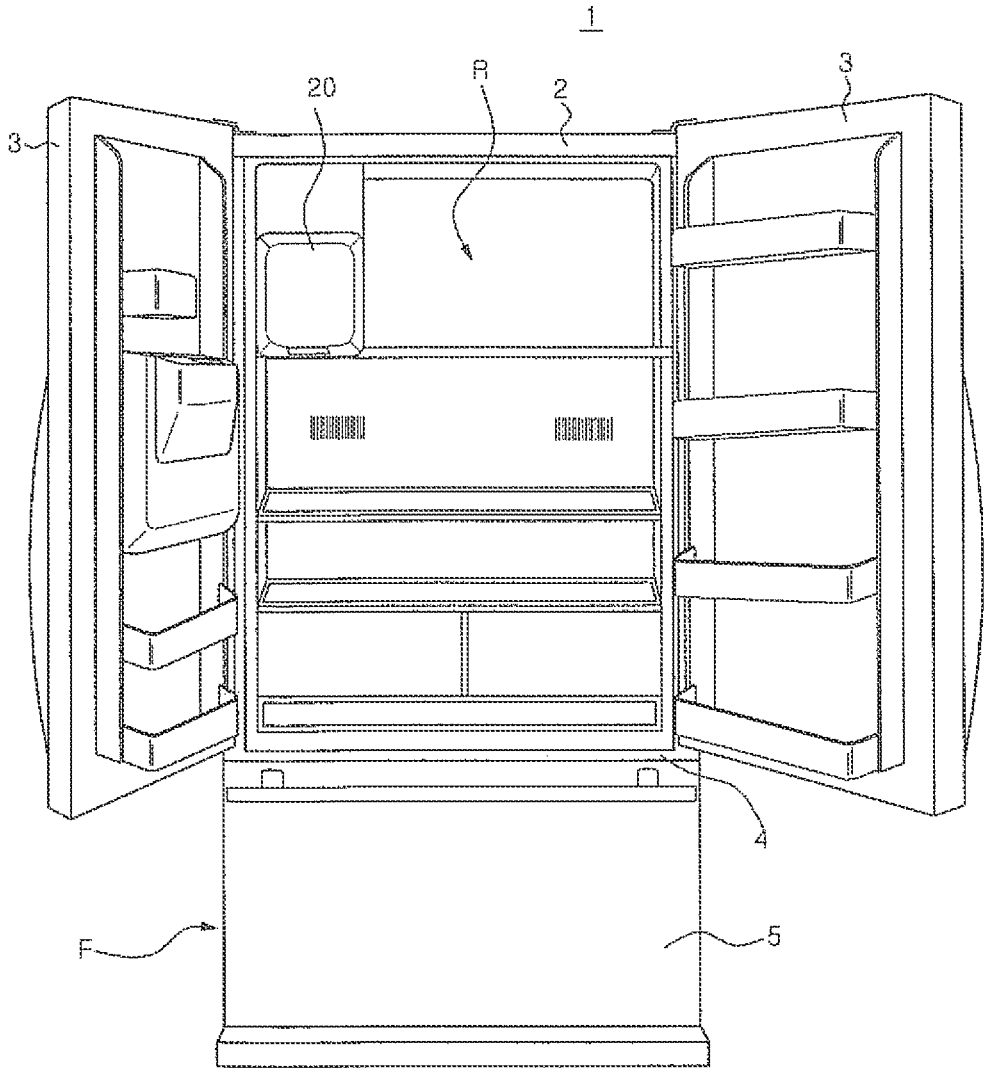
FIG. 6 is a front view of a refrigerator provided with an ice-making device including the ice tray illustrated in FIG. 1.

FIG. 6 is a front view of a refrigerator provided with an ice-making device including the ice tray illustrated in FIG. 1. FIG. 5 is The refrigerator 1 illustrating an example of one embodiment may include a main body 2 which constitutes an outer shell, a barrier 4 which divides food storage spaces (e.g., compartments, portions, rooms, etc.) formed within the main body 2. One food storage space includes an upper refrigerating compartment R and another food storage space includes a lower freezing compartment F. Refrigerating compartment doors 3 are provided on the opposite edges of the front surface of the main body 2 and configured to selectively open and close the refrigerating compartment R by the rotational movement of the refrigerating space doors 3. Freezing compartment door 5 is configured to open and close the front opening portion of the freezing compartment F by the movement of the freezing compartment door 5. In the one example implementation, an ice-making device 20 is provided in a region on one side of the upper portion of the refrigerating compartment R. The ice-making device 20 may be installed in other positions of the refrigerating compartment R or in one of the refrigerating compartment doors 3.

Figure 7:
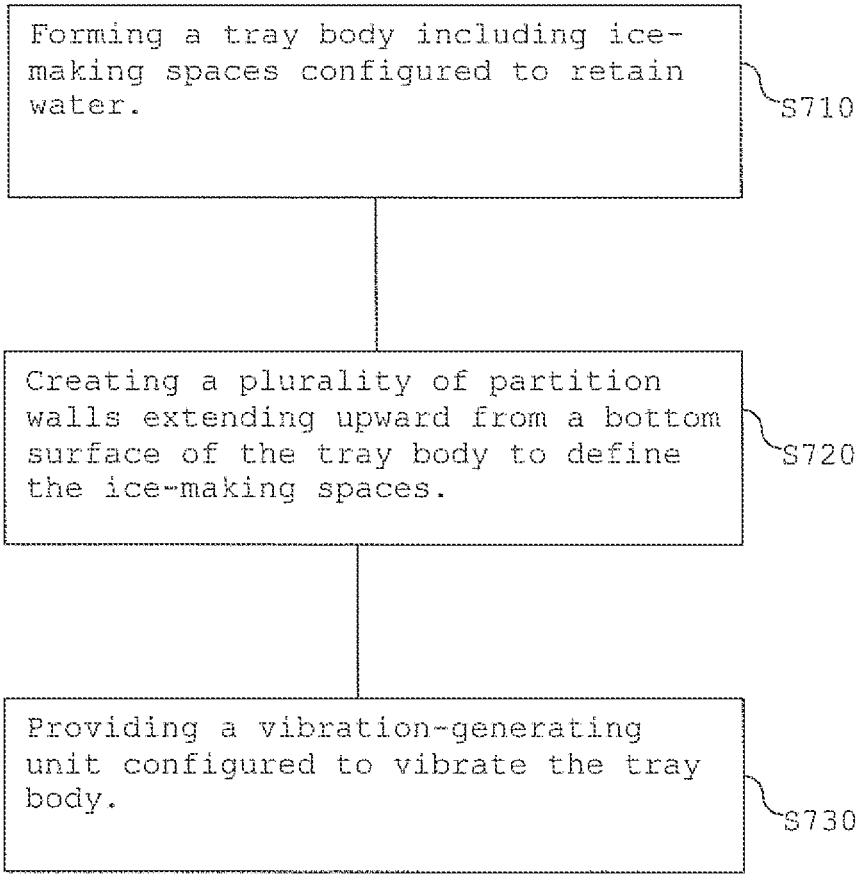
FIG. 7 is a flowchart illustrating a method of making an ice tray illustrated in FIG. 2.

FIG. 7 is a flowchart illustrating an exemplary method of making an ice tray illustrated in FIG. 2. The method comprises: forming a tray body including ice-making spaces configured to retain water (e.g., S710); creating a plurality of partition walls extending upward from a bottom surface of the tray body to define the ice-making spaces (e.g., S720); and providing a vibration-generating unit configured to vibrate the tray body (e.g., S730). The vibration-generating unit can include: a vibration-generating member configured to generate vibration; and a mounting member configured to couple the vibration-generating member to the tray body. Forming the tray body and creating the partition walls 12 can include a press work method. The press work method includes pressing a metallic material (e.g., stainless steel, brass, copper, a copper alloy, etc.).

Although exemplary embodiments of the ice tray for an ice-making device and the method of making ice according to the present disclosure have been described above with reference to the accompanying drawings, those skilled in the art will understand that the present disclosure may be implemented in various ways without changing the spirit of the present disclosure.

Therefore, it should be understood that the exemplary embodiments described above are not limiting, but are an example in all respects. The scope of the present disclosure is expressed by claims below, not the detailed description, and it should be construed that changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. The listing of steps within method claims do not imply any particular order to performing the steps, unless explicitly stated in the claim.

What is claimed is:

1. An ice tray, comprising:

a tray body including ice-making spaces configured to retain water;

a plurality of partition walls extending upward from a bottom surface of the tray body to define the ice-making spaces; and a vibration-generating unit configured to vibrate the tray body, wherein the vibration-generating unit includes:

a vibration-generating member configured to generate vibration; and a mounting member configured to couple the vibration-generating member to a lower surface of the tray body;

a shaft member provided on a surface of the mounting member and including a mounting hole extending in a longitudinal direction of the tray body; and a swing bar extending in the longitudinal direction of the tray body and inserted into the mounting hole of the shaft member, the swing bar configured to swing up and down about the shaft member when vibration is generated in the vibration-generating member.

2. The ice tray of claim 1, wherein one or more striking pieces extending upward are formed on an upper surface of the swing bar and are configured to repeatedly strike a lower surface of the tray body when the swing bar is swung.

3. The ice tray of claim 2, wherein the striking pieces are disposed at a predetermined interval along a longitudinal direction of the swing bar, and the length of the striking pieces becomes larger from a free end of the swing bar toward the shaft member.

4. The ice tray of claim 1, wherein the tray body and the partition walls are made of a metallic material and are manufactured at one time by a press work method.

5. The ice tray of claim 1, wherein the tray body and the partition walls are made of a material selected from the group consisting of stainless steel, copper and copper alloy.

* * * * *